US005201198A

United States Patent [19]

Kuhnert

[11] Patent Number: 5,201,198

[45] Date of Patent: Apr. 13, 1993

[54] SLIDER NEEDLE WITH STITCH SEPARATOR MEMBER

[75] Inventor: Gottfried Kuhnert, Westhausen, Fed. Rep. of Germany

[73] Assignee: Universal Maschinenfabrik Dr. Rudolf Schieber GmbH & Co., Westhausen, Fed. Rep. of Germany

[21] Appl. No.: 671,728

[22] PCT Filed: Aug. 26, 1989

[86] PCT No.: PCT/EP89/01006

§ 371 Date: Mar. 28, 1991

§ 102(e) Date: Mar. 28, 1991

[87] PCT Pub. No.: WO90/03463

PCT Pub. Date: Apr. 5, 1990

[30] Foreign Application Priority Data

Sep. 28, 1988 [DE] Fed. Rep. of Germany ..... 3832911
Jul. 1, 1989 [DE] Fed. Rep. of Germany ..... 3921775

[51] Int. Cl.[5] ..... D04B 35/06
[52] U.S. Cl. ..... 66/120; 66/123
[58] Field of Search ..... 66/120, 123, 121, 124

[56] References Cited

U.S. PATENT DOCUMENTS 3,050,968 8/1962 Masujima ..... 66/121
4,043,153 8/1977 Lindner et al. ..... 66/120
4,448,045 5/1984 Kuhnert ..... 66/120
4,791,794 12/1988 Schmoll ..... 66/121

FOREIGN PATENT DOCUMENTS 2112819 7/1983 United Kingdom ..... 66/120

*Primary Examiner*—Werner H. Schroeder
*Assistant Examiner*—Larry D. Worrell, Jr.
*Attorney, Agent, or Firm*—Limbach & Limbach

[57] ABSTRACT

A slider needle for knitting machines has a needle body (1) with a hook (2), a slider (3) arranged to move in the needle body (1) and a swinging member articulated on the needle body (1) behind the hook (2). To avoid excessive travel when forming a stitch and to ensure the separation between the old stitch and the strand newly fed in, there is a spring (10) in the needle body which causes the swinging the member (4) to move away from the hook (2) so that one lateral edge (7) of the swinging member (4) is almost vertical.

13 Claims, 1 Drawing Sheet

SLIDER NEEDLE WITH STITCH SEPARATOR MEMBER

BACKGROUND OF THE INVENTION

The invention relates to a slider needle for knitting machines comprising a needle body provided with a needle hook and at least one needle butt, a slider displaceably mounted in the needle body and provided with a slider butt and a swinging member articulated on the needle body behind the needle hook. Such a slider needle is known from DE-C3-151 150.

A latch needle for high speed flat knitting machines whose needle latch completely closes the head of the needle and which is pivotable by an associated spring element into a partly open intermediate position is known from DE-C3-3 702 019.

SUMMARY OF THE INVENTION

The object of the invention is to provide a slider needle of the kind described above which ensures a trouble-free and reliable separation of the old stitch from the newly laid yarn and which enables a shortening of the distance which is required for driving out the slider needle while forming stitches.

In accordance with the invention this object is achieved by means of a spring which is arranged in the needle body of a known slider needle of the type described above and which serves to hold the swinging member in a position projecting beyond the needle body.

Through constructing the slider needle in this way, the swinging member can be located very close to the needle hook, whereby the distances travelled by the slider needles when forming stitches can be considerably reduced. The old stitch is also reliably separated from the newly laid yarn. It slides very freely over the swinging member, which is then able to swing upwardly under spring pressure as soon as it is freed from the stitch. This also ensures a trouble free and reliable separation of the old stitch from the newly laid yarn even on the first needle following a carriage return when the invention is being used in conjunction with flat knitting machines or reciprocating circular knitting machines.

According to a further feature of the invention, the swinging member is rotatable away from the needle hook against the effect of the spring. In this way, when the slider needle is being driven out, the stitch can slide freely out of the needle hook.

It is also advantageous that when the swinging member pivots away from the needle hook, it substantially disappears into the body of the needle. In this way, the movement of the stitch is even further facilitated. Thereby it is possible to form a small stitch as well as to maintain the quality of the knitted stitches.

According to a further advantageous embodiment of the invention, the swinging member is substantially triangular shaped. This results in particular advantages for the movement of the stitch over the needle and the retention of the stitch on the reverse side of the swinging member after this movement.

In this connection, it is of further advantage if the swinging member has a first lateral edge, on the side thereof facing towards the needle hook, which provides a glide-surface rising up from the body of the needle in a direction away from the needle hook when the swinging member is in its projecting position. By means of the rising glide-surface on the lateral edge facing the needle hook, there results a uniform movement of the stitch over the swinging member so that this can be continually pressed down against the pressure of the spring and the stitch can slide behind the swinging member.

Preferably, the swinging member has a second lateral edge facing away from the needle hook, which extends substantially perpendicularly to the longitudinal axis of the slider needle when the swinging member is in its projecting position. In this way, it is ensured that the stitch which has slidden behind the swinging member can not slide back prematurely onto the needle hook thereby ensuring a trouble-free and reliable separation of the old stitch from the newly laid yarn especially on the first needle following a carriage return.

It is especially advantageous, if the needle body is provided with a stop which limits the swinging movement of the swinging member towards the needle hook at a first end position. In this way, a definitive position for the swinging member is assured even when no pressure is being exerted either on it or on the spring which co-operates with it. The glide-surface is thus in its proper position and its inclination is welldefined.

A further advantageous development of the invention consists in that the slider substantially covers the swinging member when the slider is approaching position for closing the needle hook. A trouble-free and reliable removal of the stitch from the slider needle is thereby assured.

Advantageously the spring is an elongated spring element. Preferably, the spring element is arranged behind the swinging member within the needle body and the free end of the spring member is in contact with a nose located at the lower end of the second lateral edge of the swinging member. In this way, a particularly small and compact construction of the slider needle is obtained.

Expediently, the swinging member exhibits a rounding at the intersection of its two lateral edges whereby a rapid and unrestricted upward swing of the swinging member is enabled and facilitated without influencing or obstructing the stitch hanging on the slider needle.

The included angle between the two end positions of the swinging member advantageously amounts to less than 45°, which has a positive effect upon the working speed of the knitting machine.

Expediently, the needle body in the vicinity of the swinging member has a camming surface by means of which the slider is lifted in such a way that its spine conceals the small swinging member when it is slid into the position where it closes the needle hook.

DESCRIPTION OF THE PREFERRED EMBODIMENT

Figure 1:
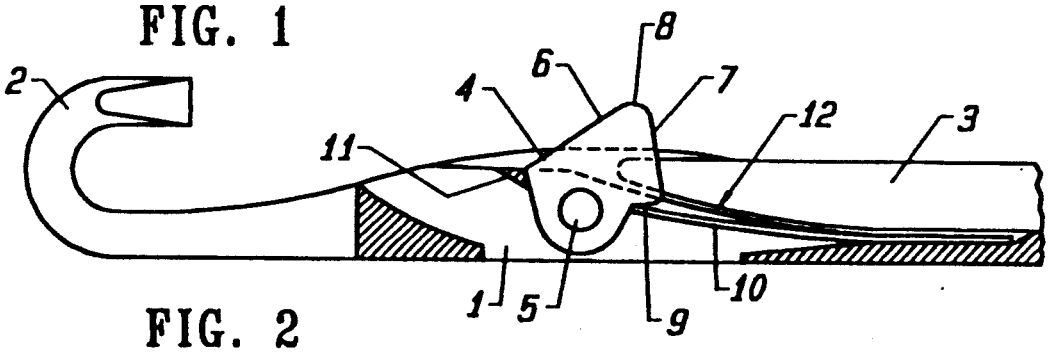
FIG. 1 illustrates in partial section the forward part of a slider needle having a spring loaded swinging member which has been swung upwardly into its basic position and FIGS. 2 to 5 illustrate a slider needle of the type illustrated in FIG. 1 with the swinging member and the slider in the various positions adopted while forming stitches.

FIG. 1 depicts the forward part of a slider needle for knitting machines comprising a needle body 1, a needle hook 2 and a slider 3 displaceably mounted within the needle body 1 in its rest position. A small, substantially triangular shaped swinging member 4 is pivotally mounted about an axis 5 behind the needle hook 1. The swinging member 4 has a first forwardly located lateral edge 6 and a second lateral edge 7. In the region of the point of intersection of the two lateral edges 6 and 7, there is provided a rounded portion 8.

At the lower end of the second lateral edge 7 of the swinging member 4, there is provided a nose 9, which is engaged by the free end of a spring 10. The spring 10, which has the form of an elongated spring element or a leaf spring, is anchored in the needle body 1 and serves to rotate the swinging member 4 into an upright position against a stop 11 located in the needle body 1. The first lateral edge 6 of the swinging member 4 forms a glide-surface for a stitch on the slider needle, whereby the swinging member 4 is rotatable against the pressure of the spring 10 into the body 1 of the needle. In the upright position, the second lateral edge 7 of the swinging member 4 is virtually perpendicular to the longitudinal axis of the slider needle. The angle included by the swinging member 4 between its two end positions preferably amounts to less than 45°.

The needle body 1, in the vicinity of the swinging member 4, has a camming surface 12 by means of which the slider 3 is lifted in such a way that its spine conceals the small swinging member 4 when it is slid into the position where it closes the needle hook 2.

Various positions of the slider 3 and the swinging member 4 during stitch formation are shown in FIGS. 2 to 5. The starting point is the rest position as shown in FIG. 1.

Figure 2:
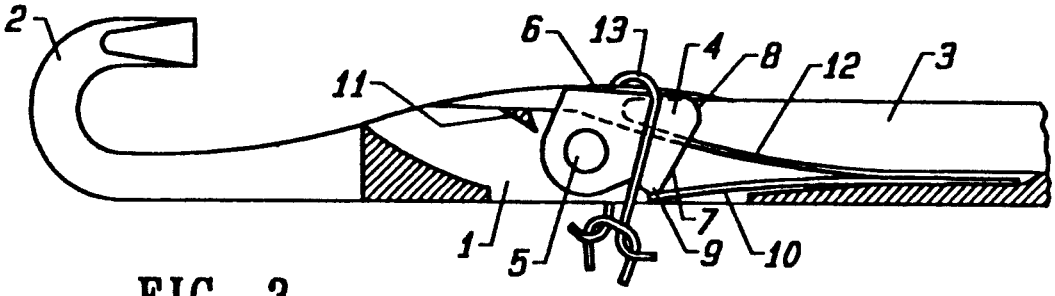

A stitch 13 hanging on the needle hook must slide to the right in order to form a new stitch when the needle is driven out. Consequently the swinging member 4 will be rotated to a hidden position into the needle body 1 by means of the stitch 13 sliding over its lateral edge 6 (FIG. 2). Apart from the slight pressure of the spring 10, the swinging member 4 offers no further resistance, so that the stitch 13 slides freely to the rear. As a result, even when the needle is only driven out a small distance, the stitch 13 slides reliably over the swinging member 4.

Figure 3:
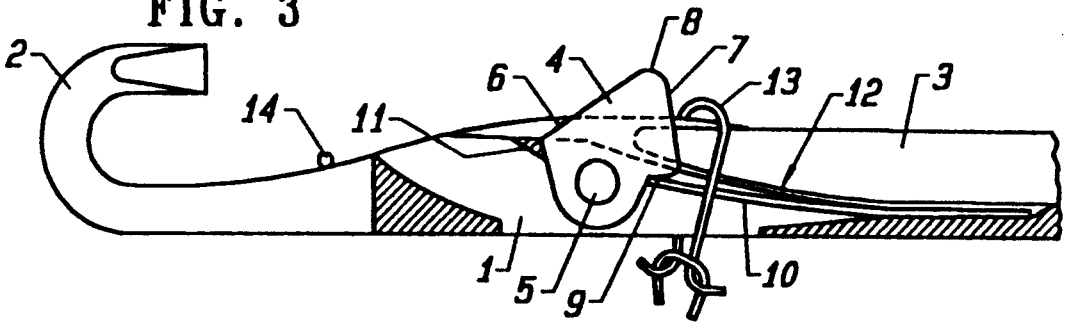

After the stitch 13 has left the first lateral edge 6 of the swinging member 4 during the driving out of the needle, the swinging member 4 is immediately rotated into its rest position by the pressure of the spring 10 (FIG. 3). Again, this has the advantage that the separation between the swinging member 4 and the needle hook 2 can be kept very small and consequently the outward movement of the needle can be made still smaller.

By virtue of the upright position of the swinging member 4, the stitch 13 is prevented from sliding back onto the needle hook 2. The old stitch is now lying on the needle body 1 or else on the slider 3 and abuts against the approximately vertical second lateral edge 7 of the swinging member. In this position of the needle, the new yarn 14 can be laid on the needle hook in known manner (FIG. 3).

Figure 4:
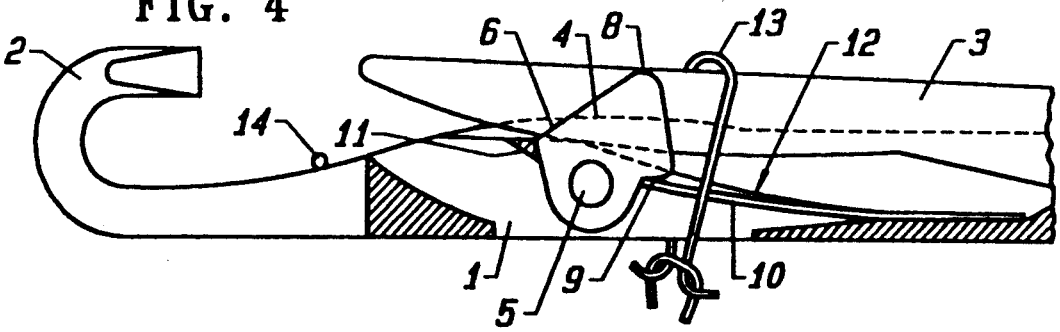

Before the needle is now retracted, the slider 3 is moved towards the needle hook 2 (FIG. 4). In so doing, the slider 3 slides up the camming surface 12 in the needle body 1 whereby, at its furthermost forward position (FIG. 5), it covers over the swinging member 4 and the needle hook 2.

Figure 5:
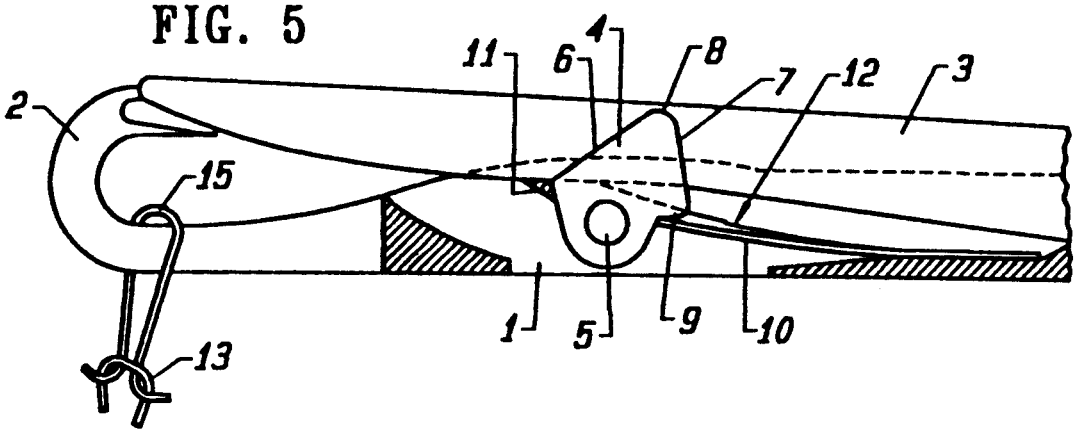

Once the slider 3 has covered over the swinging member 4 during its forward motion (FIG. 4), then the stitch 13 no longer rests on the swinging member 4. This is the position, in which, with the needle driven out, the slider 3 is moved further to the left into the position where it finally closes the needle (FIG. 5) and then, together with the needle body 1, is retracted by the amount necessary for the desired size of stitch. Consequently the old stitch 13 slides over the head of the needle and the newly laid yarn is formed into a new stitch (FIG. 5).

On the one hand, the construction of the slider needle described above permits of a minimal amount of outward movement during stitch formation and, on the other hand, ensures a reliable separation of the old stitch from the newly laid yarn. This is also assured in particular for the first needle after a carriage return in flat knitting machines or reciprocating circular knitting machines.

I claim:

1. A slider needle for knitting machines, comprising a needle body provided with a needle hook and at least one needle butt, a slider displaceably mounted in the needle body and provided with a slider butt and a swinging member rotatably mounted on the needle body behind the needle hook, the improvement comprising a spring located in the needle body which holds the swinging member in a position projecting out from the needle body.

2. The slider needle as in claim 1, wherein the swinging member is rotatable away from the needle hook against an effect of the spring.

3. The slider needle as in claim 1 whereby when the swinging member rotates away from the needle hook, to a hidden position, the swinging member substantially disappears into the needle body.

4. The slider needle as in claim 3, wherein the included angle between the projecting position and the hidden position of the swinging member amounts to less than 45°.

5. The slider needle as in claim 1, wherein the swinging member is substantially triangular shaped.

6. The A slider needle as in claim 1, wherein the needle body in a vicinity of the swinging member has a camming surface by means of which the slider is lifted in such a way that its spine conceals the swinging member when the slider is slid into a position where it closes the needle hook.

7. The slider needle as in claim 1, wherein the needle body has a stop which limits the swinging movement of the swinging member towards the needle hook at a first limiting position.

8. The slider needle as in claim 1, wherein the slider substantially covers the swinging member when the slider is approaching a position for closing the needle hook.

9. The slider needle as in claim 1, wherein the swinging member has a first lateral edge facing towards the needle hook, the lateral edge provides a glide-surface rising up from the needle body in a direction away from the needle hook when the swinging member is in its projecting position.

10. The slider needle as in claim 9, wherein the swinging member has a second lateral edge facing away from the needle hook and extending substantially perpendicular to a longitudinal axis of the slider needle when the swinging member is in its projecting position.

11. The slider needle as in claim 10, wherein the spring is an elongated spring element.

12. The slider needle as in claim 11, wherein the spring element is arranged behind the swinging member within the needle body the free end of the spring element is in contact with a nose located at the lower end of the second lateral edge of the swinging member.

13. The slider needle as in claim 10, wherein the swinging member has a rounded portion in the vicinity of the intersection of the first and second lateral edges.

* * * * *